US007887923B2

(12) United States Patent
Deng et al.

(10) Patent No.: US 7,887,923 B2
(45) Date of Patent: Feb. 15, 2011

(54) PLASMA-SPRAYED LAYERS OF ALUMINIUM OXIDE

(75) Inventors: Yi Deng, Hanau (DE); Monika Oswald, Hanau (DE); Klaus Deller, Hainburg (DE); Rolf Clasen, St. Ingbert (DE); Georg Fehringer, Haiger (DE)

(73) Assignee: Evonik Degussa GmbH, Essen (DE)

( * ) Notice: Subject to any disclaimer, the term of this patent is extended or adjusted under 35 U.S.C. 154(b) by 961 days.

(21) Appl. No.: 11/371,156

(22) Filed: Mar. 9, 2006

(65) Prior Publication Data

US 2006/0216430 A1 Sep. 28, 2006

(30) Foreign Application Priority Data

Mar. 9, 2005 (EP) ..... 05005097
Dec. 23, 2005 (EP) ..... 05112923

(51) Int. Cl.
*B32B 9/00* (2006.01)

(52) U.S. Cl. ..... 428/469; 428/472; 428/701; 428/702

(58) Field of Classification Search ..... None
See application file for complete search history.

(56) References Cited

U.S. PATENT DOCUMENTS 5,514,350 A 5/1996 Kear et al.
5,876,683 A 3/1999 Glumac et al.
6,723,387 B1 4/2004 Kear et al.
6,743,269 B2 6/2004 Meyer et al.
2003/0077398 A1 4/2003 Strutt et al.
2003/0108680 A1 6/2003 Gell et al.

FOREIGN PATENT DOCUMENTS

JP 2003328107 A 11/2003
WO 9718341 A1 5/1997
WO WO 02/92525 11/2002
WO WO 02/92525 A1 11/2002
WO WO 03/014021 2/2003
WO WO 2004/016821 2/2004
WO WO 2004/016821 A2 2/2004

OTHER PUBLICATIONS

S. Jiansirisomboon et al., Low Pressure-Sprayed $Al_2O_3$/SIC Nanocomposite Coatings From Different Feedstock Powders, Journal of the European Ceramic Society 23 (2003). pp. 961-976.
Ullmann's Enzyklopadie der tech. Chemie (Ullman's Encyclopedia of Industrial Chemistry, 4th Edition, vol. 21, 1992.
K. Varatharajan et al., "Synthesis of nanocrystalline $\alpha$-$Al_2O_3$ by ultrasonic flame pyrolysis," Materials Research Bulletin 38, Nr. 4, pp. 577-583 (2003).

*Primary Examiner*—Timothy M Speer
(74) *Attorney, Agent, or Firm*—Smith, Gambrell & Russell, LLP

(57) ABSTRACT

Plasma-sprayed layers of aluminium oxide on a substrate are produced by using a pyrogenically produced aluminium oxide, for example selected from the group consisting of borosilicate and steel, as starting powder.

4 Claims, 3 Drawing Sheets

PLASMA-SPRAYED LAYERS OF ALUMINIUM OXIDE

BACKGROUND OF THE INVENTION

1. Field of the Invention

The invention relates to plasma-sprayed layers of aluminium oxide on a substrate and to a process for producing plasma-sprayed layers of aluminium oxide.

2. Description of the Related Art

Plasma-sprayed layers of aluminium oxide are used to protect components of ships and aircraft from corrosion or wear (Herbert Hermann, Spektrum der Wissenschaft [Spectrum of Science], November 1988, page 102). These mixed aluminium oxide layers have cracks. It is also known to produce aluminium oxide layers by means of the plasma spraying process (S. Jiansirisomboon et al., Journal of the European Ceramic Society 23, (2003) 961-976). These layers likewise have cracks.

It is known to produce plasma-sprayed layers of aluminium oxide from powders on a micrometer scale. The pore sizes may in this case be in the range from 20 to 40 μm.

It is known to produce coatings by means of the plasma process from nanoscale Al2O3/TiO2 powders (U.S. Pat. No. 6,723,387).

For this purpose, it is known to produce nanoscale aluminium oxide powder by means of chemical vapour condensation (CVC). In this case, the precursor, together with a carrier gas stream, is reacted at a hot wall or in a flame reactor (U.S. Pat. No. 6,723,387). The reactors used in that document are described in documents U.S. Pat. No. 5,514,350 and U.S. Pat. No. 5,876,683.

According to U.S. Pat. No. 5,514,350, non-agglomerated nanostructured (n-ceramic) powders are produced from organometallic precursors by the organometallic precursors in a carrier gas stream being thermally decomposed in a hot fluidized-bed reactor. In particular, powders of the formula n-$SiCxN_4$ are obtained from hexamethyldisiloxane. The document does not describe a pyrogenic process in which evaporable metal oxide/metal compounds are hydrolyzed in the hydrogen-oxygen flame to form the pure oxides.

According to U.S. Pat. No. 5,876,683, non-agglomerated oxidic powders are produced in the size of nanoparticles by an evaporated organometallic compound being mixed with an oxygen-containing fuel gas stream, this gas stream being fed to a flame and burnt there, with a pressure of from 1 to 50 mbar being maintained in the reaction chamber.

The non-agglomerated oxides produced can be applied to a cooled roller or, if the flame is configured as a plasma flame, direct to a substrate, with a solid layer being formed on the substrate.

It is also known for nanostructured aluminium oxide which has been produced by means of the CVC method in a hot-wall reactor to be suspended in an organic liquid and this suspension to be processed by means of the plasma spraying process (US 2003/0077398 A1).

It is also known to produce mechanically stable, crack-free layers of aluminium oxide produced by flame spraying in a thickness of from 50 to 1000 μm in order to increase the stability of components made from quartz, such as for example quartz crucibles. Details as to the structure of the $Al_2O_3$-layer are not given (WO 02/092525 A1).

It is also known to produce an amorphous material by means of plasma spraying by aluminium oxide mixed with other oxides being fed to the plasma (WO 2004/016821).

The known $Al_2O_3$-layers may disadvantageously have defects, such as pores and cracks. This residual porosity may have an adverse effect on the micro-hardness and wear resistance.

The object therefore exists of producing plasma-sprayed layers of aluminium oxide which have a minimum number of defects, such as cracks and pores within the layer, and a high resistance to wear.

BRIEF SUMMARY OF THE INVENTION

The subject matter of the invention is plasma-sprayed layers of aluminium oxide on a substrate, which are characterized in that the particles of the aluminium oxide in the layer have a size of from 20 to 30 nm (nanometers) and are predominantly in the α-phase. In one particular embodiment of the invention, a pyrogenically produced aluminium oxide is used to produce the plasma-sprayed layers.

The layers of aluminium oxide according to the invention can be applied to a substrate, consisting of steel or of borosilicate glasses.

A further subject of the invention is a process for producing the plasma-sprayed layer of aluminium oxide, which is characterized in that a pyrogenically produced aluminium oxide is used as starting powder in a plasma spraying process that is known per se.

The pyrogenically produced (fumed) aluminium oxide can be produced using the known process of flame or high-temperature hydrolysis, in particular the flame hydrolysis for the production of pyrogenically produced oxides (Ullmann's Enzyklopädie der techn. Chemie [Ullman's Encyclopedia of Industrial Chemistry], 4th Edition, volume 21, page 464 (1982).

The pyrogenically produced aluminium oxide can be produced, for example, from aluminium trichloride, which is evaporated, mixed with dry air and hydrolyzed in a hydrogen-oxygen flame to form aluminium oxide.

The aluminium oxide precipitates as Aerosil and is passed through a cooling or coagulation section, where the aluminium oxide coagulates or agglomerates and flocculates.

The pyrogenically produced aluminium oxide may have a primary particle size of 13±5 μm. It may have a tapped density of 50±25 g/l. Furthermore, it may have an aluminium oxide content of more than 99.6% by weight.

The aluminium oxide used may, for example, be the pyrogenically produced aluminium oxide C. The physico-chemical data of aluminium oxide C are listed in Table 1.

In one embodiment of the invention, it is possible to use a pyrogenically produced aluminium oxide which has been granulated.

In another embodiment of the invention, the starting powder used may be pyrogenically produced aluminium oxide granules which have been produced by pyrogenically produced aluminium oxide being dispersed in water and then spray-dried.

This product is known from WO 03/014021. It is a granulated material based on pyrogenically produced aluminium oxide with a mean particle diameter of from 5.0 to 150 μm and a tapped density of from 300 to 1.200 g/l.

These aluminium oxide granules are produced by Degussa AG under the name AEROPERL® Alu 100/30.

TABLE 1

| | | Aluminium oxide C |
|---|---|---|
| Behaviour with respect to water | | hydrophilic |
| BET surface area[1)] | $m^2/g$ | 100 ± 15 |
| Mean size of the primary particles | nm | 13 |
| Tapped density approx. value[2)] compacted material | g/l | approx. 50 |
| Relative density[10)] | g/ml | approx. 3.2 |
| Drying loss[3)] on leaving the delivery plant (2 hours at 105° C.) | % | <5.0 |
| Ignition loss[4)7)] (2 hours at 1000° C.) | % | <3 |
| pH[5)] | | 4.5-5.5 |
| $SiO_2$[8)] | | <0.1 |
| $Al_2O_3$[8)] | | <99.6 |
| $Fe_2O_3$[8)] | | <0.2 |
| $TiO_2$[8)] | | >0.1 |
| HCI[8)9)] | | <0.5 |
| Sieve residue[6)] (according to Mocker, 45 μm) | % | <0.05 |

[1)]in accordance with DIN 66131
[2)]in accordance with DIN ISO 787/XI, JIS K 5101/18 (unsieved)
[3)]in accordance with DIN ISO 787/II, ASTM D 280, JIS K 5101/21
[4)]in accordance with DIN 55921, ASTM D 1208, JIS K 5101/23
[5)]in accordance with DIN ISO 787/IX; ASTM D !" = (; JIS K 5101/24
[6)]in accordance with DIN ISO 787/XVIII; JIS K 5101/20
[7)]based on the substance which has been dried for 2 hours at 105° C.
[8)]based on the substance which has been calcined for 2 hours at 1000° C.
[9)]HCI content is a component of the ignition loss The plasma spraying process is known from S. Jiansirisomboon et al. Journal of European Ceramic Society 23 (2003), 961-976.

Plasma spraying belongs to the thermal spraying processes.

In the case of atmospheric plasma spraying (APS), a plasma is generated from a gas (primary gas) with the aid of a direct current between a water-cooled anode and a water-cooled cathode. This gas is, for example, nitrogen or forming gas. Different temperatures can be generated in the plasma flame depending on the type of gas. With this type of plasma (thermal plasma), the high temperature (several 10000 K) is obtained by the dissociated ions recombining in the plasma.

In addition to the high temperature of the plasma, very high gas outlet velocities from the plasma gun occur. These velocities may be in the range of several 100 m/s. As a result, the particles, which are melted in the flame, impact on the substrate at a high velocity. In the process, some of the impact energy is converted into heat.

The gas velocity can be varied and increased by introducing an additional gas (secondary gas).

On account of the high flame temperatures and the high gas velocities, it is possible to process high-melting materials, such as for example $Al_2O_3$.

Figure 1:
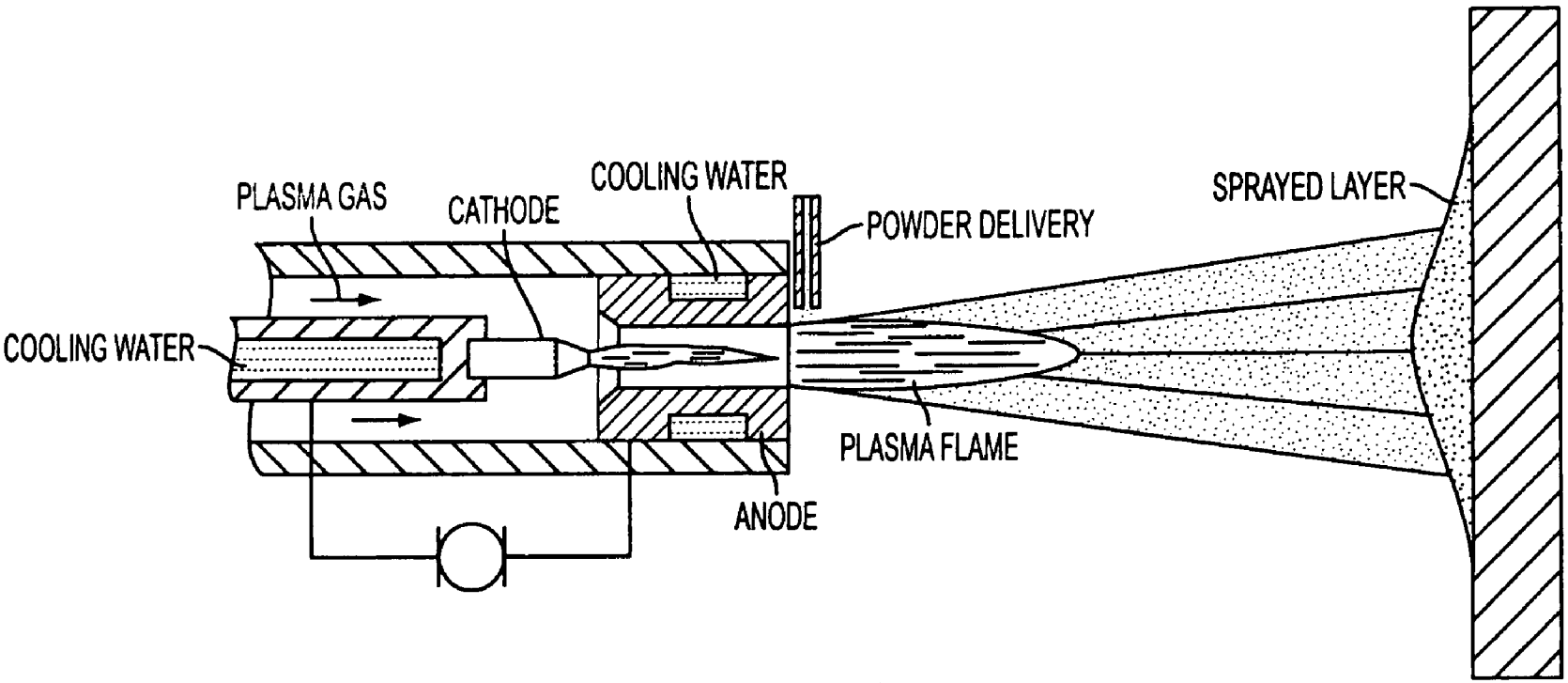
FIG. 1 shows the introduction of the starting powder into the plasma flame with the aid of a gas stream.

The starting powder is introduced either axially or radially directly into the plasma flame with the aid of a gas stream. The basics of the process are illustrated in FIG. 1. The following parameters can be varied during atmospheric flame spraying, thereby predetermining the properties of the layers: Electric power (flame temperature), primary gas flow (flame temperature, gas outlet velocity), secondary gas flow (gas outlet velocity), powder delivery rate (layer application rate), substrate-plasma gun distance (residence time of the particles in the flame).

The layer thicknesses of the plasma-sprayed layers may be in the range from a few μm to a few cm.

Different substrate materials may be appropriate depending on the type of sprayed layer and its use. The plasma-sprayed layer is generally used to improve the properties of the substrate material.

For example, the $Al_2O_3$-layer according to the invention can be used to improve the wear resistance, the thermal insulation or the corrosion resistance. Both metals (e.g. steels), ceramics (e.g. $Al_2O_3$ or $ZrO_2$) and glasses (e.g. borosilicate glass) are suitable for use as substrates.

The linear expansion coefficients of the substrates and of the layers should be matched to one another in order to prevent the layer from flaking. If the expansion coefficients are very different, it is possible to use interlayers (e.g. Ni—Cr—Al), the expansion coefficients of which are between those of the substrates and the actual functional layers.

In the case of the $Al_2O_3$-layers according to the invention, based on aluminium oxide granules, if the substrate used is steel it is advantageously possible to employ, for example, Ni—Cr—Al as an interlayer.

The production according to the invention of plasma-sprayed $Al_2O_3$-layers using aluminium oxide granules has the advantage that the layers are sintered at the same time as they are being applied.

On account of the short sintering time, the grain size of the particles has increased only slightly. The AEROXIDE® Alu C particles have a particle size of approx. 13 nm.

Figure 2:
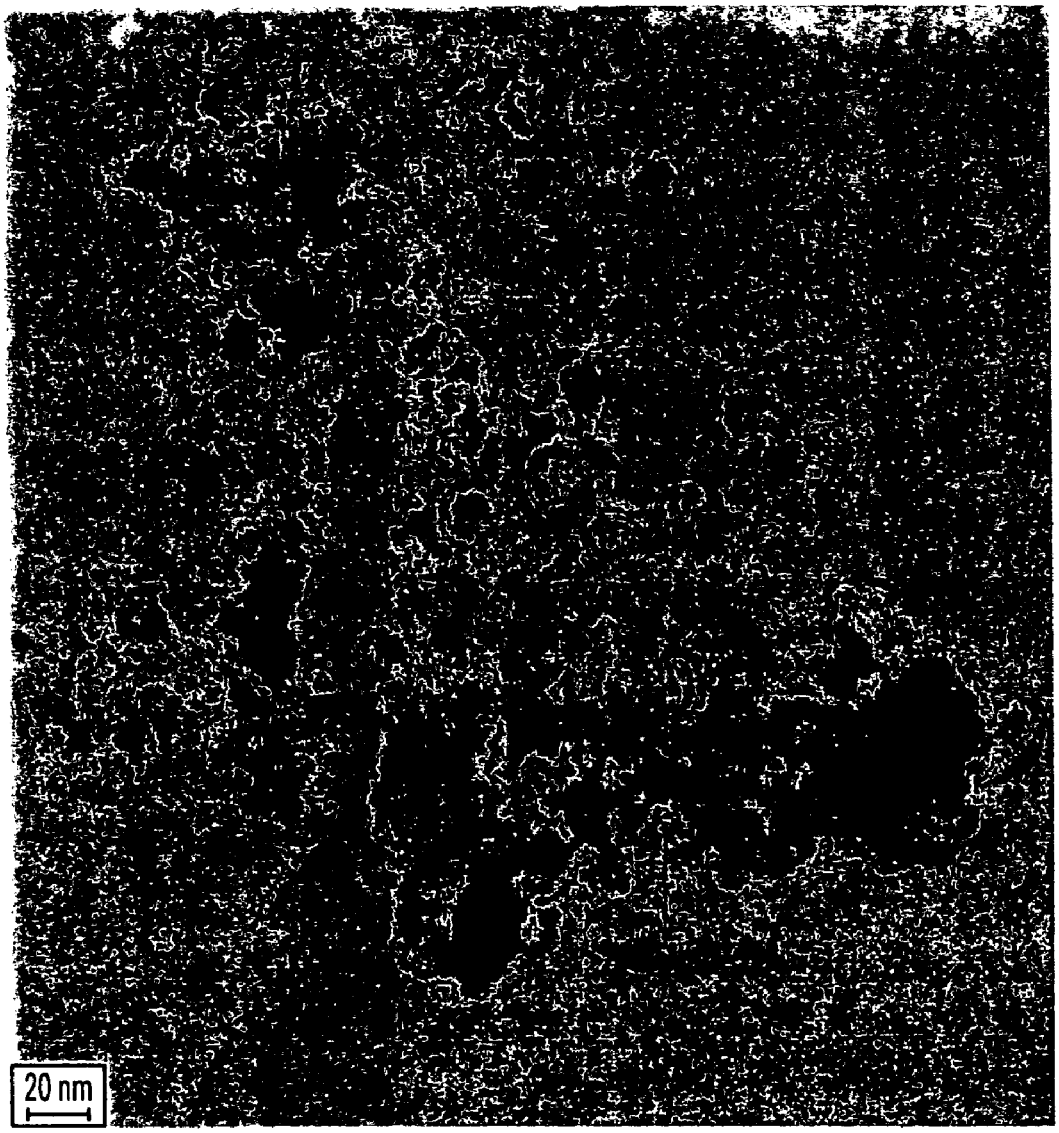
FIG. 2 shows the TEM image.

As can be seen from the TEM image shown in FIG. 2, the particles in the plasma-sprayed layer according to the invention have a particle size of 20~30 nm.

The plasma spraying was carried out with a power of 35 kw and a substrate-gun distance of 13 cm.

Figure 3:
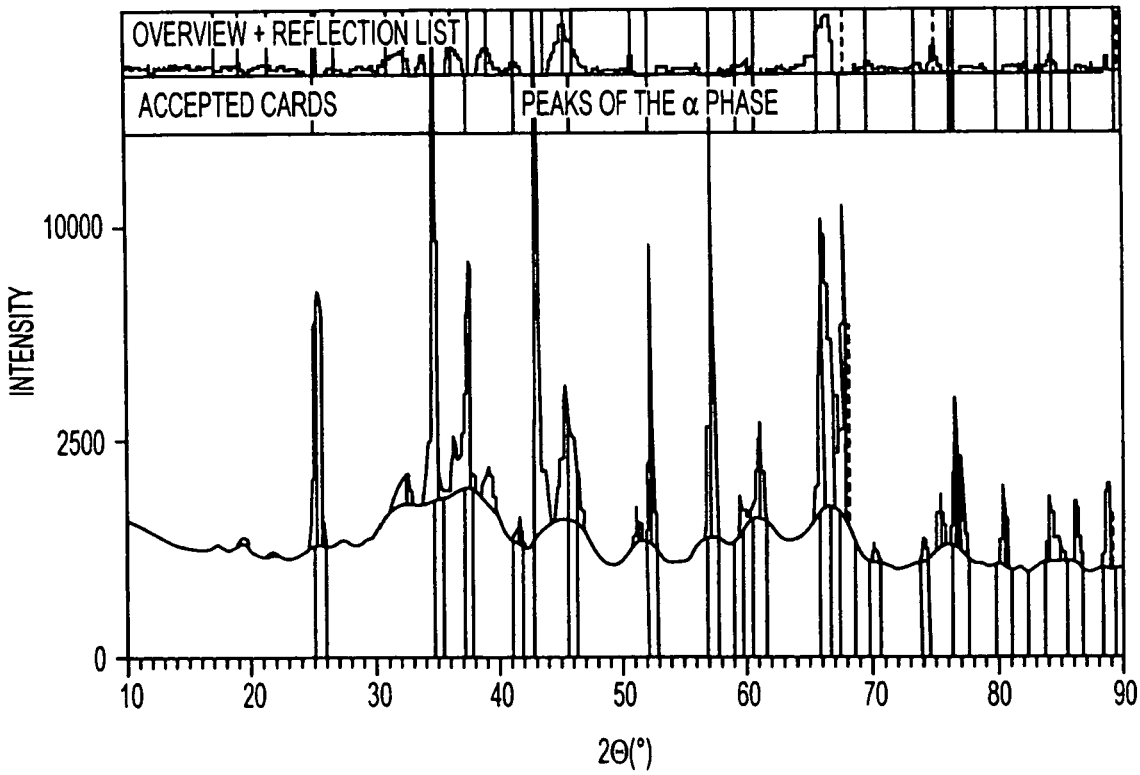
FIG. 3 shows layers produced by the plasma process.

The layers produced by the plasma process in accordance with the invention primarily comprise the desired α-phase (FIG. 3).

With the known sintering method (sintering in a furnace), a longer sintering time is required and the particles grow very considerable up to a particle size of a few hundred nanometers.

The plasma-sprayed layers of aluminium oxide according to the invention can be used in the field of wear or corrosion protection, for example for components for ships or aircraft. The use of the plasma-sprayed layers according to the invention with a nanoscale structure allows the properties of these layers to be configured in such a way as to provide a higher resistance to wear and corrosion. The basis for this is the minimizing of the defects, such as cracks and pores, within the layer.

Moreover, the process according to the invention has the advantage that in particular the conveying installations do not become blocked, on account of the advantageous free-flowing properties of the aluminium oxide granules used.

EXAMPLES

The spraying tests were carried out using AEROPERL® Alu 100/30, granules based on pyrogenically produced aluminium oxide (produced by Degussa AG) using APS (Metco F4).

The AEROPERL® Alu 100/30 has the following physicochemical characteristic data:

| | Units | Guideline values |
|---|---|---|
| Specific surface area (BET) | $m^2/g$ | 85-115 |
| pH | | 4.0-6.0 |
| Drying loss | % | <=2.5 |
| Tapped density (approx. value) based on DIN ISO 787/CI, August 1983 | g/l | 500 |
| Ignition loss 2 h 1000° C., based on the dried substance (2 h at 105° C.) | % | <=4.5 |
| $Al_2O_3$-content (1) (1) based on the calcined substance | % | >=99.6 |
| Cilas d50 | μm | 30 |

The powder was used to carry out spraying tests on circular steel blanks (ST37, 110 mm ϕ). Layers in the range from 100-160 μm were sprayed with the aid of a mask (100 mm ϕ).

Depending on the spraying parameters, the application capacity was approx. 22-33%.

On account of the low density of the material, the powder delivery rates are approx. 2.8-3.2 g/min (Degussa $Al_2O_3$). The volume of powder delivered was comparable to crushed grades.

The spraying parameters associated with the specimens are given in Table 2. In total, only four circular blanks were sprayed.

TABLE 2

| Specimen | Argon (l/min) | H2 (l/min) | Current (A) | Carrier gas AR (l/min) | Delivery quantity (gr/min) | Layer thickness (μm) | Application capacity (%) |
|---|---|---|---|---|---|---|---|
| Degussa 3 | 40 | 5 | 650 | 5 | approx. 2.8 | ~160 | approx. 33 |
| Degussa 4 | 40 | 12 | 650 | 5 | approx. 2.8 | ~160 | approx. 33 |
| Degussa 5 | 40 | 8 | 650 | 10 | approx. 3.2 | ~130 | approx. 25 |
| Degussa 6 | 50 | 8 | 650 | 5 | approx. 2.8 | ~130 | approx. 28 |

Electrical breakdown test were carried out on the APS-sprayed layers. The breakdown strengths are in the range of standard plasma-sprayed aluminium oxide layers. The results are given in Table 3.

TABLE 3

Measured values for the breakdown strength of the APS-sprayed specimens. The discharge currents for 500 V (DC) are also given.

| Specimen No. | Layer thickness | Discharge current (μA) Voltage | Start | End | Breakdown voltage [kV] | Mean value (Discharge current or breakdown voltage) | Measurement position |
|---|---|---|---|---|---|---|---|
| 1 | 118 | 500 V | 293 | 51 | | | 1 |
| | | 500 V | 268 | 49 | | | 2 |
| | | 500 V | 234 | 47 | | 49 | 3 |
| | | | | | 1.2 | | 4 |
| | | | | | 1.1 | | 5 |
| | | | | | 1.1 | 1.13 | 6 |
| 2 | 158 | 500 V | 369 | 53 | | | 1 |
| | | 500 V | 315 | 57 | | | 2 |
| | | 500 V | 236 | 55 | | 55 | 3 |
| | | | | | 1.6 | | 4 |
| | | | | | 1.7 | | 5 |
| | | | | | 1.5 | | 6 |
| 3 | 121 | 500 V | 161 | 42 | | 39 | 1 |
| | | 500 V | 163 | 38 | | | 2 |
| | | 500 V | 168 | 38 | | | 3 |
| | | | | | 1.2 | | 4 |
| | | | | | 1.3 | | 5 |
| | | | | | 1.2 | | 6 |
| 4 | 108 | 500 V | 426 | 124 | | | 1 |
| | | 500 V | 435 | 113 | | | 2 |
| | | 500 V | 398 | 119 | | 119 | 3 |
| | | | | | 1.2 | | 4 |
| | | | | | 1.2 | | 5 |
| | | | | | 1.1 | 1.17 | 6 |

The invention claimed is:

1. A layered substrate comprising plasma-sprayed layers of aluminium oxide, wherein the particles of the aluminium oxide in the layer have a size of from 20 to 30 nm (nanometers) and are predominantly in the $\alpha$-$Al_2O_3$-phase, and are obtained from granular aluminium oxide produced from a spray dried aqueous dispersion of pyrogenically produced aluminium oxide having a mean particle diameter of from 5.0 to 150 μm and a tapped density of from 300 to 1,200 g/l.

2. The layered substrate of claim 1, wherein the substrate comprise steel, glass, or ceramics.

3. The layered substrate of claim 1 wherein the layers impart wear resistance, thermal insulation and/or corrosion resistance.

4. The layered substrate of claim 1 wherein the layers further comprise an interlayer that prevents flaking.

* * * * *